US005086297A

United States Patent [19]

Miyake et al.

[11] Patent Number: 5,086,297

[45] Date of Patent: Feb. 4, 1992

[54] PLASMA DISPLAY PANEL AND METHOD OF FORMING FLUORESCENT SCREEN THEREOF

[75] Inventors: Toru Miyake; Naoshige Higuchi; Yoshiki Kudo; Hisao Tanabe, all of Tokyo, Japan

[73] Assignee: Dai Nippon Insatsu Kabushiki Kaisha, Japan

[21] Appl. No.: 364,119

[22] Filed: Jun. 12, 1989

[30] Foreign Application Priority Data

| | | | |
|---|---|---|---|
| Jun. 14, 1988 | [JP] | Japan | 63-146374 |
| Jun. 14, 1988 | [JP] | Japan | 63-146375 |
| Dec. 7, 1988 | [JP] | Japan | 63-309419 |

[51] Int. Cl.[5] ..... G09G 3/04; H01J 17/49; B05D 1/36

[52] U.S. Cl. ..... 340/759; 340/772; 313/485; 427/72; 427/73

[58] Field of Search ..... 340/759, 771, 772, 781; 313/485, 487, 489, 512, 518, 457, 469, 482, 586, 584, 587; 315/169.4; 355/53; 445/24, 25, 6, 27; 427/38, 64, 71, 73, 157, 43.1, 108; 204/192.22, 181.1, 192.1; 65/31; 156/663, 657

[56] References Cited

U.S. PATENT DOCUMENTS

| | | | |
|---|---|---|---|
| 3,589,789 | 6/1971 | Hubert et al. | 204/181.1 |
| 3,735,183 | 5/1973 | Walters | 340/771 |
| 3,916,393 | 10/1975 | Criscimagna et al. | 313/587 |
| 3,934,172 | 1/1976 | Okamoto | 313/485 |
| 4,078,095 | 3/1978 | Ratay | 927/73 |
| 4,116,792 | 9/1978 | Byrum, Jr. | 204/192.22 |
| 4,293,586 | 10/1981 | Unnai et al. | 427/73 |
| 4,325,002 | 4/1982 | Kobale et al. | 313/485 |
| 4,352,042 | 9/1982 | Lorenz et al. | 313/485 |
| 4,382,979 | 5/1983 | Tanaka et al. | 427/157 |
| 4,391,885 | 7/1983 | Tomita et al. | 427/64 |
| 4,444,616 | 4/1984 | Fujita et al. | 156/663 |
| 4,485,158 | 11/1984 | Harper | 427/71 |
| 4,562,434 | 12/1985 | Amano | 340/779 |
| 4,670,296 | 6/1987 | Akiba | 427/73 |
| 4,692,662 | 9/1987 | Wada et al. | 313/587 |
| 4,756,793 | 7/1988 | Peek | 427/38 |
| 4,780,644 | 10/1988 | Sakai et al. | 340/771 |
| 4,827,186 | 5/1989 | Knauer et al. | 313/485 |

OTHER PUBLICATIONS

Handbook of Printed Circuit Manufacturing, Raymond H. Clark, Van Nostrand Reinhold Company, 1985, Chapter 11, pp. 216–218.

*Primary Examiner*—Alvin E. Oberley
*Assistant Examiner*—Steve Saras
*Attorney, Agent, or Firm*—Parkhurst, Wendel & Rossi

[57] ABSTRACT

A method of forming a fluorescent screen for a plasma display panel provided with a front plate and a rear plate disposed parallel to each other and a cell barrier mounted on the front or rear plate and constituting a plurality of cells as display elements is characterized in that the cell barrier is located on a surface of the front or rear plate facing the other plate, a slurry solution containing a phosphor is filled in a portion defined by a cell wall of the cell barrier on the front or rear plate, only the wall surface of the cell barrier is exposed, and so a photosensitive layer containing a phosphor is formed at a portion inside the cell barrier. The fluorescent screen forming method is further characterized in another aspect in that a slurry solution containing a phosphor fills inside the cell of the cell barrier disposed on the plate, the plate is inclined immediately thereafter with an inclination of about 90° or more degrees with respect to a horizontal plane, the rear plate in an inclining state is settled till the phosphor in the slurry solution is precipitated on the cell wall of the cell barrier, and the cell wall after the precipitating process is dried and hardened.

9 Claims, 8 Drawing Sheets

PLASMA DISPLAY PANEL AND METHOD OF FORMING FLUORESCENT SCREEN THEREOF

BACKGROUND OF THE INVENTION

This invention relates to a plasma display panel and a method of forming a fluorescent screen of a plasma display panel.

There is generally known a DC (direct current) or an AC (alternating current) type plasma display panel or unit in which front and rear plates are arranged parallel to each other and a cell barrier constituting a plurality of display element cells is disposed between the front and rear plates.

The fluorescent screen or surface of the DC or AC type plasma display panel having the structure described above, is formed by the steps of coating a photosensitive slurry containing a phosphor to the rear surface of the front plate, exposing the coated surface by utilizing a photomask corresponding to the pattern of the fluorescent screen to be formed, and finally developing and calcinating the exposed surface.

Utilized as the photosensitive slurry is a mixture containing a phosphor, PVA(poly vinyl alcohol), or diazonium salt, for example, and a defoaming agent or surfactant may be added as occasion demands.

In the case when light is observed by the eyes of an operator after transmission through this formed fluorescent screen itself, the amount of the light is reduced during the passage through the fluorescent screen. For this reason, in the conventional technology, there has been developed a plasma display panel in which a fluorescent screen is formed on the wall surface of the cell barrier for increasing the luminance of the light, and the reflected light of the light emitted from the fluorescent screen is observed.

The plasma display panel of the type described above utilizes a spacer provided with holes each having a trapezoidal cross section as a cell barrier, and a slurry solution containing a phosphor is fed into the hole from a widened opening side thereof. The slurry solution containing a phosphor is coated on the wall surface of the spacer hole by sucking the slurry solution from the other side of the hole to thereby form the fluorescent screen on the spacer wall surface.

With the conventional fluorescent screen forming method of the character described above, it is necessary to coat and suck the slurry solution containing a phosphor to form the fluorescent screen on the wall surface of the spacer, and accordingly, the front plate and the rear plate are assembled with the spacer after the formation of the fluorescent screen on the wall surface of the spacer. This assembling working makes it difficult to precisely adjust the positions of the front and rear plates and the spacer, which requires high-precision work for the preparation of the spacer member. The spacer member is prepared by providing holes in a photosensitive glass material with hydrofluoric acid. However, in the present technique, it is difficult to provide a photosensitive glass having a size of more than about $30\times30$ cm$^2$. Accordingly, it is not applicable to utilize the photosensitive glass to the large sized plasma display panels which are required for the recent industrial use. In addition, the recent plasma display panel mainly requires a discharging space having a thickness of about 100 to 200 $\mu$m and hence it is difficult to assemble the spacer in such discharging space and handle such a thin glass.

Furthermore, the conventional DC or AC type plasma display panel has a structure in which the cell barrier is attached to either the front plate or the rear plate and a cathode (cathode and anode in the AC type plasma display panel) is formed on the rear plate so that it is impossible to apply the conventional fluorescent screen forming technique as it is.

SUMMARY OF THE INVENTION

An object of this invention is to eliminate the defects or drawbacks encountered in the prior art described above and to provide a method of easily and precisely forming a fluorescent screen or surface on a wall surface of a cell barrier of a plasma display panel.

Another object of this invention is to provide a plasma display panel formed by the method according to this invention and provided with a fluorescent screen having excellent characteristics.

These and other objects can be achieved according to this invention, in one aspect, by providing a method of forming a fluorescent screen for a plasma display panel provided with a front plate and a rear plate disposed parallel to each other and a cell barrier mounted on the front or rear plate, and constituting a plurality of cells as display elements, the method characterized in that the cell barrier is located on the surface of the front or rear plate, a slurry solution containing a phosphor is filled in a portion defined by a cell wall of the cell barrier on the front or rear plate, only the wall surface of the cell barrier is exposed, and so a photosensitive layer containing a phosphor is formed at a portion inside the cell barrier.

In another aspect, according to this invention, there is provided a method of forming a fluorescent screen for a plasma display panel provided with a front plate and a rear plate disposed parallel to each other and a cell barrier mounted on the front or rear plate and constituting a plurality of cells as display elements, the method being characterized in that a slurry solution containing a phosphor is filled inside the cell of the cell barrier on the front or rear plate, the cell barrier mounted plate is inclined immediately thereafter with an inclination of about 90° or more degrees with respect to a horizontal plane, the plate in an inclining state is settled till the phosphor in the slurry solution precipitates on the cell wall of the cell barrier, and the cell wall is dried and hardened after the precipitating process.

In a further aspect, according to this invention, there is provided a plasma display panel comprising a front plate having a rear surface, a rear plate as a substrate having a front surface which opposes the rear surface of the front plate and in which a cell barrier provided with a plurality of cells is mounted, the rear plate being arranged parallel to the front plate, and a fluorescent screen formed on a wall surface of the cell and the rear surface of the front plate.

In a still further aspect according to this invention, there is provided a plasma display panel comprising a front plate having a rear surface, a rear plate as a substrate having a front surface opposing the rear surface of the front plate and on which a cell barrier is mounted, the rear plate being arranged parallel to the front plate, a fluorescent screen formed on a wall surface of the cell, and a color filter means formed on the rear surface of the front plate.

The preferred embodiments according to this invention will be described in further detail hereunder with reference to the accompanying drawings.

BRIEF DESCRIPTION OF THE DRAWINGS

In the accompanying drawings:

FIGS. 4 through 9 represent the first embodiment according to this invention, in which FIG. 4 is a vertical section of a substrate on which a cell barrier is formed; FIG. 5 is a view similar to that shown in FIG. 4, but a slurry solution containing a phosphor is applied to a cell of the cell barrier; FIG. 6 shows a view similar to that shown in FIG. 5 for showing an exposure process; FIG. 7 is a perspective view of the cell barrier provided with circular cells; FIG. 8 is a perspective view of the cell barrier provided with rectangular cells; and FIG. 9 is a vertical section of the plasma display panel which is exposed by utilizing a mask;

FIGS. 10 through 15 represent the second embodiment according to this invention, in which FIG. 10 is a vertical section of a substrate on which a cell barrier is formed; FIGS. 11 and 15 are views showing the state where a photosensitive coating agent containing a phosphor is applied to the plasma display panels, respectively; FIG. 12 is a sectional view showing the state where light is irradiated by utilizing a mask; FIG. 13 is a sectional view showing the state where the photosensitive coating agent containing the phosphor remains only on the wall surface of the cell barrier; and FIG. 14 is a sectional view showing a plasma display unit utilizing the base plate formed by the method represented by FIG. 10 through 13;

FIGS. 16 through 23 represent the third embodiment according to this invention, in which FIG. 16 is a vertical sectional view of a substrate on which a cell barrier is formed; FIG. 17 is a view similar to that shown in FIG. 16 for representing a fluorescent screen formation process; FIG. 18 is a view representing the exposure status; FIG. 19 shows a chart showing the formation processes according to the third embodiment; FIG. 20 is a perspective view of the cell barrier provided with circular cells; FIG. 21 is a perspective view of the cell barrier provided with rectangular cells; FIG. 22 is a vertical section of the plasma display panel exposed by utilizing a mask member; and FIG. 23 is a vertical section of the DC type plasma display panel provided with a cell barrier in a linear arrangement.

DESCRIPTION OF THE PREFERRED EMBODIMENTS

Figure 1:
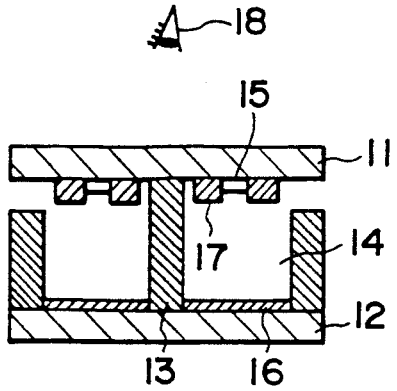
FIG. 1 is a cross sectional view of a conventional DC type plasma display panel.
Figure 2:
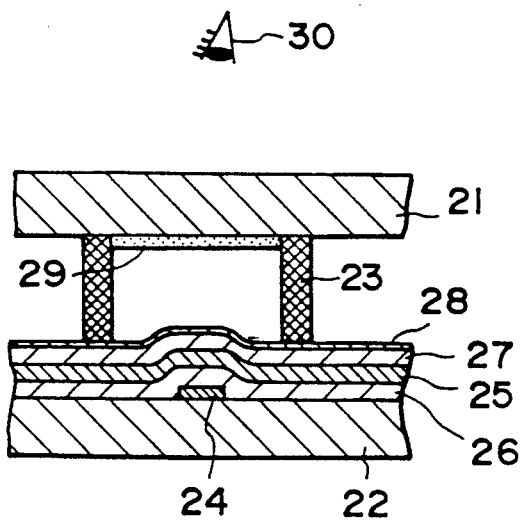
FIG. 2 is a cross sectional view of a conventional AC type plasma display panel.
Figure 3:
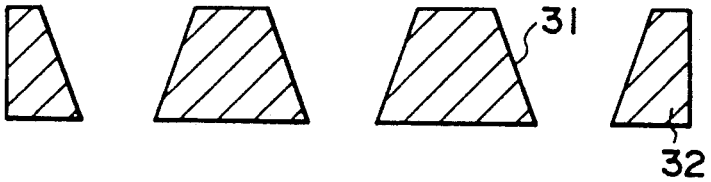
FIG. 3 shows a cross section of a conventional spacer for a plasma display panel.

For a better understanding of this invention, a conventional DC type plasma display panel, an AC type plasma display unit, and a spacer utilized for a cell barrier provided with holes in each trapezoidal cross section will be first described hereunder with reference to FIGS. 1, 2 and 3, respectively.

FIG. 1 shows a conventional DC type plasma display panel, in which flat front and rear plates 11 and 12 both made of glass are arranged parallel to each other in an opposing fashion. A cell barrier 13 is secured to the front (upper as viewed) surface of the rear plate 12 thereto and to define cells 14 therein, and a space having a proper volume is maintained between the front and rear plates 11 and 12 by the location of the cell barrier 13. Anodes 15 are formed on the rear (lower as viewed) surface of the front plate 11, and a cathode 16 is formed on the front surface of the rear plate 12 so as to be normal, in plan view, to the anodes 15. Fluorescent screens 17 are formed adjacent to both sides of the anodes 15.

According to the conventional DC type plasma display panel shown in FIG. 1, discharge is caused in the respective cells 14 defined between the front and rear plates 11 and 12 and the cell barrier 13 by applying an electric field between the anodes 15 and the cathode 16. The discharge creates ultraviolet rays which illuminate the fluorescent screens 17 and the light through the front plate 11 is observed by a viewer 18.

FIG. 2 shows a conventional AC type plasma display unit, in which flat front and rear plate 21 and 22 both made of glass are arranged parallel to each other in opposing fashion. A cell barrier 23 is secured to the front (upper as viewed) surface of the rear plate 22 thereto and to define cells therein. A space having a proper volume is maintained between the front and rear plates 21 and 22 by the location of the cell barrier 23. Two electrodes 24 and 25 arranged normal to each other in plane view, are formed on the front surface of the rear plate 22 through a layer 26 of an electrically dielectric layer. A second electrically dielectric layer 27 and a protective layer 28 are laminated on the dielectric layer 26. A fluorescent screen 29 is formed on the rear (lower as viewed) surface of the front plate 21.

According to the conventional AC type plasma display unit shown in FIG. 2, discharge is caused in the respective cells 14 defined between the front and rear plates 21 and 22 and the cell barrier 23 by applying an electric field between the two electrodes 24 and 25. The discharge creates ultraviolet rays which illuminate the fluorescent screen 29 and the light through the front plate 21 is observed by a viewer 30.

FIG. 3 shows a conventional spacer means 32 to be disposed between the front and rear plates and provided with holes 31 each having a trapezoidal cross section.

A slurry solution containing a phosphor is supplied into the spacer 32 through widely opened sides (upper side as viewed) of the holes 31 by a screen printing technique or by means of a spray, and the slurry solution is sucked from the other opening sides of the holes 31 to spread the slurry solution over the wall surface of the hole 31 of the spacer 32.

However, these conventional plasma display panels involve the various problems described hereinbefore.

Preferred embodiments according to this invention for overcoming the problems of the prior art will be described hereunder with reference to FIGS. 4 to 25.

FIRST EMBODIMENT

1-1 Basic Structure

Figure 4:
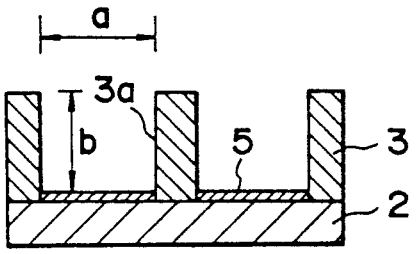

FIGS. 4 through 9 represent the first embodiment for forming a fluorescent screen or surface according to this invention, and the first embodiment represents a case in which a fluorescent screen is formed on a cell wall surface of a cell barrier secured to a rear plate of a DC type plasma display panel. A rear plate 2 made of a flat glass substrate is provided with a front (upper as viewed) surface to which a cell barrier 3 is secured to be normal to the front surface of the rear plate 2 so as to define a proper space between the rear plate and a front plate, not shown. Cathodes 5 are formed on the front surface of the rear plate 2. As shown in FIG. 4, the inner dimension of an opening of the cell is provided as "a" and the height of the cell barrier is provided as "b" for convenience's sake.

Figure 5:
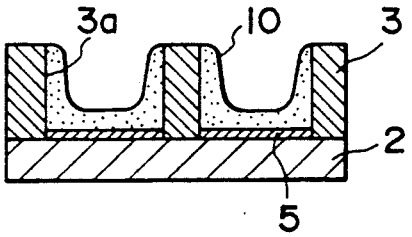
Figure 6:
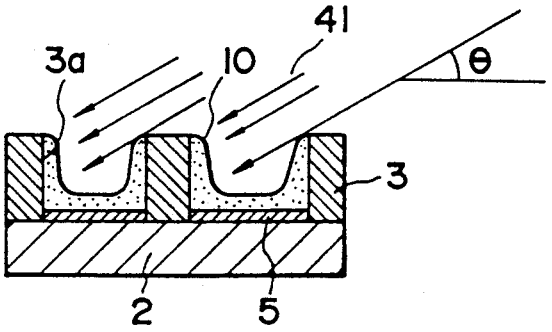

In the next step shown in FIG. 5, a liquid of a photosensitive material 10 containing a phosphor is coated on the inner portion of the cell barrier 3. The coating is carried out by various methods, such as, by means of a spray utilizing a mask, by a screen printing technique, or by a method in which the photosensitive liquid 10 is first coated on the entire surface of the substrate and the front end portion of the cell barrier 3 is scraped by a scraper made of rubber, for example, to thereby coat the liquid 10 to only the inner portion of the cell barrier 3.

According to this embodiment, the photosensitive liquid containing a phosphor 10 is uniformly and adequately adhered to the cell wall surface of the cell barrier 3 by rotating the rear plate 2, inclining the same or reversing it to the extent that the liquid 10 is not dropped, after the photosensitive liquid has been coated. In this embodiment, a photosensitive liquid, i.e., negative type, which is hardened (not dissolved) by the exposure is used.

After the photosensitive liquid 10 has dried, light is irradiated so that the shadow of the cell barrier 3 causes oblique light to not be irradiated onto the front surface of the rear plate. The inclination angle of the irradiation is expressed as follows.

$$\theta = \arctan (b/a)$$

Figure 8:
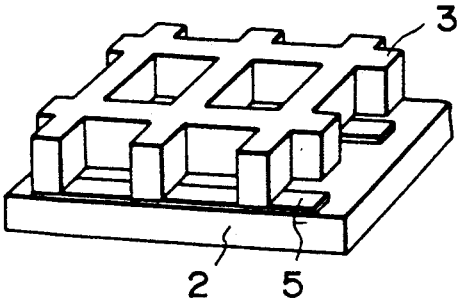
Figure 9:
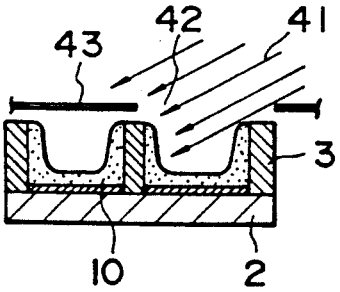
Figure 10:
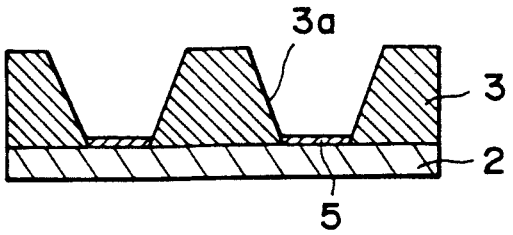

When the light having an inclination as defined by the above equation is irradiated, the light 41 only irradiates the wall surface 3*a* of the cell barrier 3 and, hence, only the photosensitive liquid 10 coating the wall surface 3*a* of the cell barrier 3 is exposed and hardened. Such an exposure process is carried out for the respective cell walls (four in case of a matrix cell arrangement such as shown in FIG. 8), whereby all fluorescent layers on the wall surfaces of the cell barrier 3 are exposed and hardened. The fluorescent layer on the bottom surface of the substrate is thereafter removed by developing treatment and the fluorescent layer remains only on the wall surfaces 3*a*.

Figure 7:
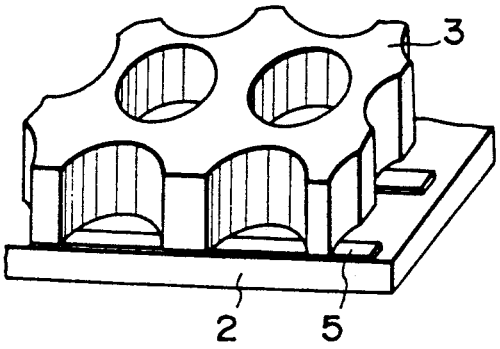

In a case where the cell enclosed by the cell barrier 3 has a circular shape as shown in FIG. 7, the phosphor will adhere only to the wall surface 3*a* of the cell barrier 3 by rotating the rear plate 2 and exposing the surface 3*a* to the light 41 while maintaining the irradiation inclination $\theta$. In the case where the cell enclosed by the cell barrier 3 has a rectangular shape as shown in FIG. 8, the light cannot uniformly expose the phosphor coated on the wall surface 3*a* of the cell barrier 3 with the irradiation inclination $\theta$ maintained because of the difference between the inner dimensions of the long and short sides of the rectangular cell. Accordingly, the irradiation of the light will have to be carried out by changing the inclination with respect to the respective sides of the cell by rotating the rear plate 2 by 90°.

When it is required to adhere multiple-colored (for example, red, blue and green) phosphor to the respective cells, a mask 43 having an opening 42 at predetermined portions of the mask 43 will be disposed above the rear plate 2 so that only the desired wall surface of the cell barrier 3 can be exposed to the light through the opening 42. This operation is repeated with respect to the respective colors to form a multiple-colored fluorescent screen. Alternatively, it may be possible to preliminarily coat the inner surface of the cell with the photosensitive liquids containing a phosphor of multiple kinds in accordance with the desired pattern and to then simultaneously expose the cell walls of the respective colors.

In the final step, a calcinating process is carried out for substantially removing the photosensitive material and remaining only the phosphor on the wall surface of the cell barrier 3.

The following are the phosphors utilized for this embodiment for the respective colors of red, blue and green.

For red; $Y_2O_3$:Eu, $Y_2SiO_5$:Eu, $Y_3Al_5O_{12}$:Eu, $Zn_3(PO_4)_2$:Mn, $YBO_3$:Eu, (Y,Gd)$BO_3$:Eu, $GdBO_3$:Eu, $ScBO_3$:Eu, $LuBO_3$:Eu. For blue; $Y_2SiO_5$:Ce, $CaWO_4$:Pb, $BaMgAl_{14}O_{23}$:Eu. For green; $Zn_2SiO_4$:Mn, $BaAl_{12}O_{19}$:Mn, $SrAl_{13}O_{19}$: Mn, $CaAl_{12}O_{19}$:Mn, $YBO_3$:Tb, $BaMgAl_{14}O_{23}$:Mn, $LuBO_3$:Tb, $GdBO_3$:Tb, $ScBO_3$:Tb, $Sr_6Si_3O_8Cl_4$:Eu.

As a photoresist for scattering the phosphor, a PVA-ADC, PVA-diazonium salt or the like may be utilized, and as a solvent of slurry liquid state, water, alcohol or both mixture or the like may be used. The concentration of the phosphor of the slurry liquid state is 10 to 60 weight % for the slushing method, or 30 to 80 weight % for the screen printing method, and the concentration of the vehicle is 0.5 to 8 weight %.

In the foregoing, only the DC type flat substrate is referred to, but substantially the same processes are carried out for the AC type flat substrate according to this invention.

1-2 Actual Example

According to the screen printing method, a nickel electrode was formed on the glass substrate with the width of 200 μm, and a cell barrier of a square matrix structure having a height (b) of 200 μm, a width of 200 μm, a pitch of 1 mm and an inner dimension (a) of 800 μm is also formed on the glass substrate.

A photosensitive liquid containing a phosphor was prepared by adding $Zn_2SiO_4$:Mn (green color) of 60 wt % as a phosphor and a PVA-diazonium salt of 8 wt % into water. The thus prepared liquid was coated on the respective wall surfaces of the cell barrier on the glass substrate by the screen printing method, and then dried. After the drying process, the cell barrier 3 was exposed to the light irradiated with an inclination of 14° (arctan (200 μm/800 μm)). Since the cell has a square inner shape, the substrate was rotated by 90° to perform exposure four times once for each of the respective cell walls. After the exposing process, the substrate is developed with hot water and then calcinated at a temperature of about 440° C. for 15 minutes, whereby a plasma display panel provided with a cell barrier only on which the fluorescent screen having a thickness of 10 μm was formed can be obtained.

1-3 Effects

According to the first embodiment of this invention, the fluorescent screen can be easily and precisely formed on the wall surfaces of the cell barrier and it is possible to provide a plasma display panel having an effective luminance by observation of the light reflected from the fluorescent screen.

SECOND EMBODIMENT

2-1 Basic Structure

FIGS. 10 to 15 represent the second embodiment according to this invention, in which a cell barrier 3 is secured to the front (upper as viewed) surface of a rear plate 2 made of a flat glass substrate. The cell barrier 3 serves to define the distance between the rear plate 2 and a front plate, not shown, and is provided with cell openings widening upwardly. Cathodes 5 are formed on the front surface of the rear plate 2.

Figure 11:
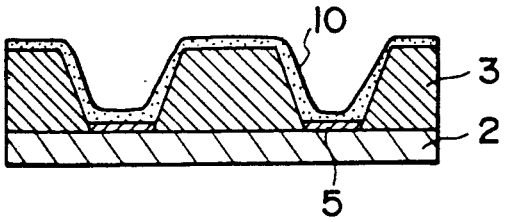

Referring to FIG. 11, a photosensitive liquid containing a phosphor is coated on the front side of the cell barrier 3 to form a photosensitive layer 10. In this embodiment, a negative type photosensitive material which is hardened by the irradiation of light is utilized. Although the photosensitive liquid may be coated by means of a spray or splash-flow method, it is preferred to carry out the coating in accordance with the spraying method by which a uniform coating can be effected. With the splash-flow method, the photosensitive liquid may be spread uniformly in the case where the photosensitive liquid has a low viscosity, but in such a case, the photosensitive liquid is liable to stay in the bottom portion of the rear plate 2, and accordingly, it may be necessary to rotate, incline, or reverse the substrate after the coating of the photosensitive liquid in order to uniformly coat the same to the front side of the rear plate 2.

Figure 12:
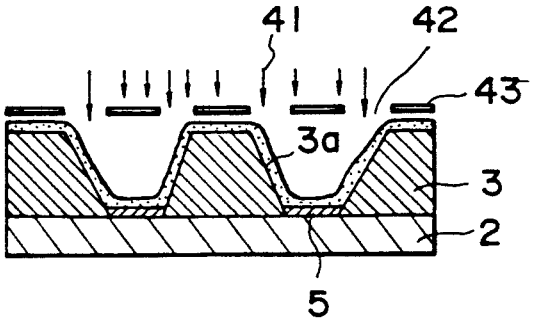

Referring to FIG. 12, a mask 43 is disposed above the cell barrier 3 and the mask 43 is provided with openings 42 so that the light irradiated from the upper portion of the cell barrier 3 can irradiate only the cell wall surfaces 3*a* and the light towards the upper flat surface of the cell barrier and the front surface of the rear plate is shut out. After the location of the mask 43, the light is irradiated from the upper portion of the cell barrier 3 to irradiate only the cell wall surfaces 3*a* through the openings 42 of the mask 43, whereby only photosensitive layer 10 including the phosphor coated on the cell wall surfaces 3*a* is exposed and hardened. The substrate is thereafter developed, and only the photosensitive layers 10 including the phosphor on the cell wall surfaces 3*a* remain.

The following are the phosphors utilized for this embodiment for the respective colors of red, blue and green.

For red; $Y_2O_3$:Eu, $Y_2SiO_5$:Eu, $Y_3Al_5O_{12}$:Eu, $Zn_3(PO_4)_2$:Mn, $YBO_3$:Eu, (Y,Gd)$BO_3$:Eu, $GdBO_3$:Eu, $ScBO_3$:Eu, $LuBO_3$:Eu. For blue; $Y_2SiO_5$:Ce, $CaWO_4$:Pb, $BaMgAl_{14}O_{23}$:Eu. For green; $Zn_2SiO_4$:Mn, $BaAl_{12}O_{19}$:Mn, $SrAl_{13}O_{19}$:Mn, $CaAl_{12}O_{19}$:Mn, $YBO_3$:Tb, $BaMgAl_{14}O_{23}$:Mn, $LuBO_3$:Tb, $GdBO_3$:Tb, $ScBO_3$:Tb, $Sr_6Si_3O_8Cl_4$:Eu.

As a photoresist for scattering the phosphor, a PVA-ADC, PVA-diazonium salt or the like may be utilized, and as a solvent of slurry liquid state, water, alcohol or both mixture or the like may be used. The concentration of the phosphor of the slurry liquid state is 10 to 60 weight % for the slushing method, or 30 to 80 weight % for the screen printing method, and the concentration of the vehicle is 0.5 to 8 weight %.

The formation of the multiple color fluorescent screen is carried out by the following two methods, one in which a mask (photomask) provided with openings formed at portions corresponding to the fluorescent screens of the respective colors is utilized and the exposure process carried out in a repeated manner with respect to the respective colors, and the other in which the photosensitive liquid containing the phosphor is coated on the respective cell surfaces by means of a spray through a mask provided with predetermined openings for coating the phosphor of the desired color such as red, blue or green and thereafter substantially the same processes as those referred to the slushing method are carried out in a repeated manner.

Figure 13:
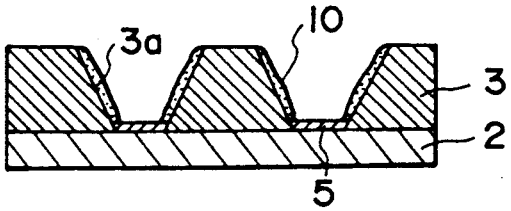

Finally, as shown in FIG. 13, the substrate is calcinated for substantially removing the photosensitive material and leaving only the phosphor on the wall surfaces of the cell barrier 3.

Figure 14:
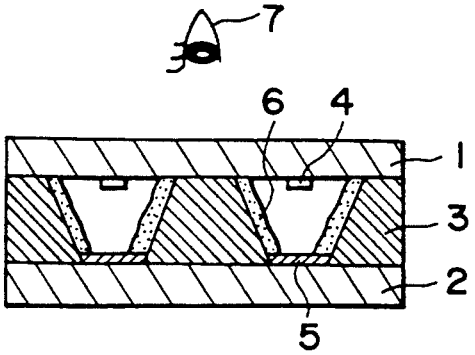

Referring to FIG. 14, a front plate 1 provided with a rear (lower as viewed) surface on which are arranged anodes 4 so as to oppose to the front surface of the cell barrier 3, whereby a plasma display panel provided with a fluorescent screen 6 on the wall surface 3*a* of the cell barrier 3 can be formed.

Figure 15:
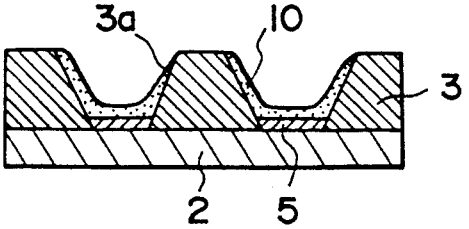

Alternatively, referring to FIG. 15, it may be possible to coat the photosensitive liquid containing the phosphor on only the inner cell surface of the cell barrier 3. Utilized in such a case is a screen printing method or a method in which the photosensitive liquid containing the phosphor is once coated over the entire surface of the cell barrier and the coating applied to the front flat surface of the cell barrier 3 is thereafter scraped by a scraper made of rubber, for example, whereby the coating on the inner cell surface of the cell barrier can remain. In the next step, as described hereinbefore with reference to FIG. 12, the mask 43 is arranged over the rear plate 2 and the light irradiated from the upper portion of the mask plate 43 through the openings provided in the mask 43.

With the second embodiment described above, the photosensitive liquid containing the phosphor is utilized, but, in a modification, it may be possible to utilize a phototacky agent which is made adhesive when exposed in place of the photosensitive liquid containing a phosphor. In such case, the phototacky agent coated on the wall surface of the cell barrier is only exposed to the light to be made adhesive, and thereafter, the powders of the phosphor are adhered thereon, whereby the fluorescent screen can be also formed on the wall surface of the cell barrier in this modification.

The DC type flat substrate is referred to hereinabove with reference to the second embodiment of this invention, but substantially the same processes may be effected to the AC type flat substrate to provide the plasma display panel.

2-2 Actual Example

According to the screen printing method, a nickel electrode was formed on the glass substrate to the width of 200 μm, and a cell barrier having a lower width of 300 μm, an upper width of 100 μm, and a height of 200 μm, was prepared by an overlapped coating manner.

A photosensitive liquid containing a phosphor was prepared by adding $Zn_2SiO_4$:Mn (green color) of 30 weight % as a phosphor and a PVA-diazonium salt of 4 weight % into water. The thus prepared coating agent was coated on the respective cell surfaces of the cell barrier on the glass substrate by the spraying method, and then dried. After the drying process, the cell barrier 3 is exposed to the light irradiated from the upper portion of the cell barrier through openings formed in the mask located above the front end of the cell barrier only to expose the wall surfaces of the cell barrier. After the exposing process, the substrate is developed with hot water and then calcinated at a temperature of about 440° C. for 15 minutes, whereby a plasma display panel provided with a cell barrier having the cell wall only on which the fluorescent screen having a thickness of 10 μm was formed, could be obtained.

2-3 Effects

According to the second embodiment of this invention, the fluorescent screen can be easily and precisely formed on the wall surfaces of the cell barrier and it is possible to provide a plasma display panel having an effective luminance by the observation of the light reflected from the fluorescent screen.

THIRD EMBODIMENT

3-1 Basic Structure

Figure 16:
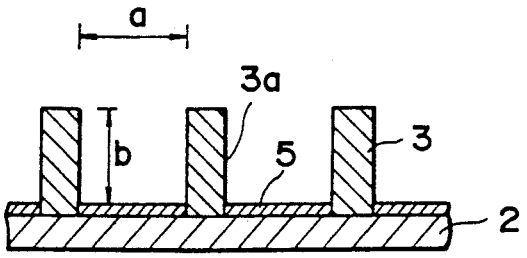
Figure 17A:
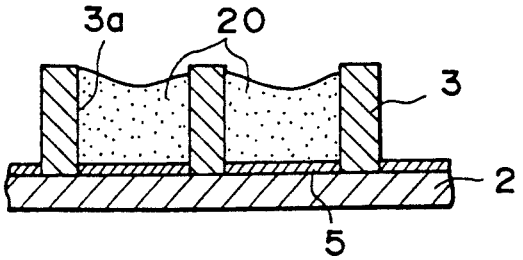
Figure 17B:
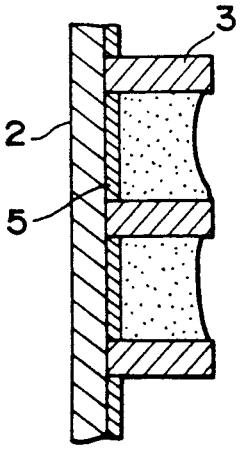
Figure 17C:
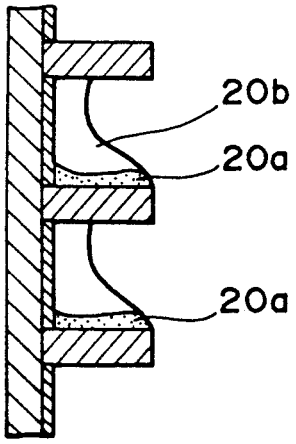
Figure 17D:
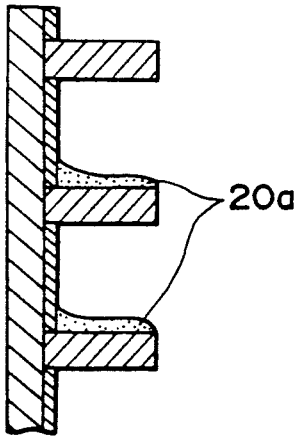
Figure 18:
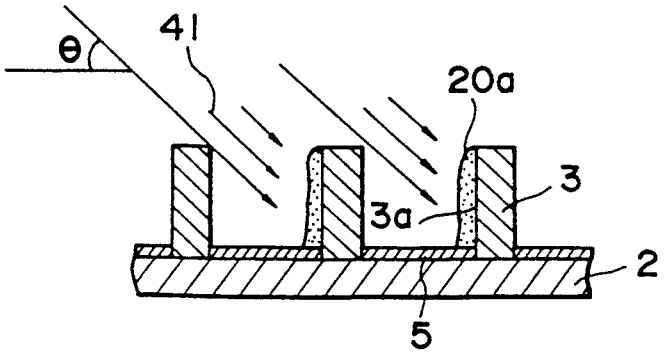

FIGS. 16 to 23 represent the third embodiment according to this invention, in which FIGS. 16 to 18 show the structures of the embodiments for forming a fluorescent screen or surface in a plasma display panel according to this invention, the structures being applied to cases wherein the fluorescent screens are formed on the wall surfaces of the cell barrier secured to the front or rear plate of a DC type plasma display panel.

Referring to FIG. 16, a cell barrier 3 is secured to the front (upper as viewed) surface of a rear plate 2 made of a flat glass substrate to define a space between the rear plate and a front plate, not shown. The cell barrier has a lattice structure. Cathode 5 is formed on the front surface of the rear plate 2. In the illustration, the inner dimension of an opening of the cell of the cell barrier 3 is referred to as "a" and the height thereof is referred to as "b".

A slurry liquid containing a phosphor is filled in the openings of the cell barrier 3 as shown in FIG. 17*a*, the rear plate 2 is raised in a vertical fashion as shown in FIG. 17*b* immediately after the filling of the slurry in the openings. The rear plate 2 is maintained as it is until the time when the phosphor 20*a* contained in the slurry liquid is moved and precipitated to the wall surface of the cell barrier 3 as shown in FIG. 17*c*. After the adequate drying process, the phosphor 20*a* is adhered on the wall surface of the cell barrier 3 as shown in FIG. 17*d*.

The fluorescent slurry liquid containing a phosphor 20 is filled in the interior of the openings of the cell barrier 3 by means of a spray, a screen printing method, or a method in which the slurry is coated on the entire surface of the substrate and the front end portion of the cell barrier is thereafter scraped by a scraper made of rubber for example. In these methods, it is preferred to preliminarily wet the substrate for the smooth and uniform filling of the slurry.

It will be understood that the fluorescent screen is formed on the four surfaces of the inner wall of the cell barrier 3 by repeating the processes described above four times, and in a modification, the fluorescent screen can be formed on the four wall surfaces of the cell barrier 3 by drying the wall surfaces while rotating the rear plate 2 in the standing position, after filling of the fluorescent slurry liquid. In this modified method, however, the thickness of the thus formed fluorescent screen is about ¼ of the thickness thereof formed in the former method.

As the photosensitive liquid, a negative type photosensitive liquid which is hardened (undissolved) by the exposure, was utilized.

After the drying of the fluorescent slurry liquid, the light 41 is irradiated, as shown in FIG. 18, from an oblique direction so that the light is not irradiated to the inner bottom portion of the cell barrier of the rear plate 2 by shutting the light with the side wall portion of the cell barrier 3. In this irradiation, the inclination $\theta$ of the light is determined as follows.

$$\theta = \arctan (b/a)$$

When the light 41 is irradiated with the irradiation inclination $\theta$ obtained by the above equation, the light is irradiated only to the wall surface 3*a* of the cell barrier 3, whereby the phosphor 20*a* precipitated only on the wall surface 3*a* of the cell barrier 3 can be exposed and then hardened.

When the thus described exposure process is carried out for the wall surfaces of the respective cells after the process represented by FIG. 17 has been performed, all the phosphor layer on the wall surfaces 3*a* of the cells has been hardened. The phosphor adhered on the bottom surface of the substrate without being precipitated during the precipitation process will be removed by performing the developing operation for every exposure and hence, the phosphor layer can be formed only on the wall surface 3*a* of the cell barrier 3.

In a modification, the phosphor may be hardened by thermal treatment. However, it will be understood as a matter of course that it is necessary to fill the phosphor in the cell and then harden the same in a selective manner when a multicolor phosphor is utilized.

Figure 19:
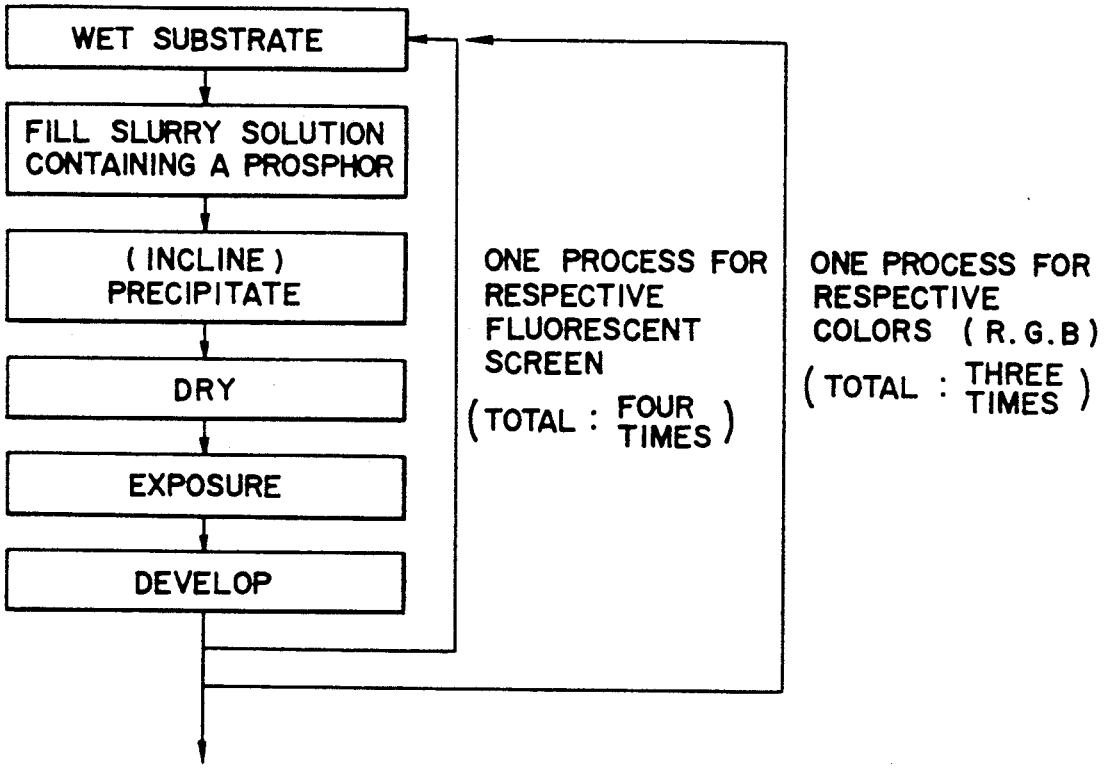

The processes described above will be represented by a chart shown in FIG. 19.

Figure 20:
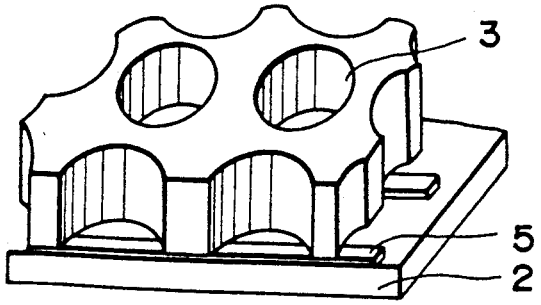

In a case where the cell surrounded by the cell wall of the cell barrier has a circular configuration, as shown in FIG. 20, the rear plate 2 is rotated in a standing position, to precipitate the phosphor. Thereafter, the rear plate 2 is exposed to the light at the inclination described hereinbefore while rotating the same, whereby it is possible to form the fluorescent screen on only the wall surface 3*a* of the circular cell.

Figure 21:
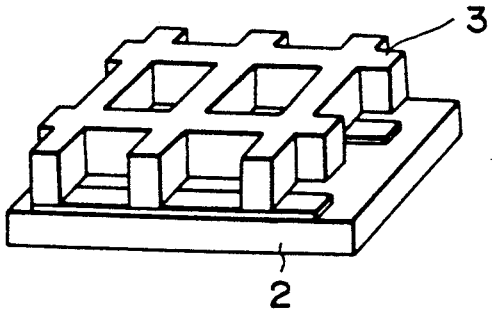

FIG. 21 represents a case in which the cell has a rectangular shape having a long side and a short side, that is, the length "a" in FIG. 16 is different in the long and short sides of the cell. In this case, it is impossible to uniformly expose the phosphor layers adhered on the long and short side surfaces of the cell by the manner described with respect to the cell having the circular shape. Accordingly, in this case, the exposures are performed respectively for the long side surface and the short side surface of the cell by changing the irradiation inclinations while rotating the rear plate 2 by 90°.

Figure 22:
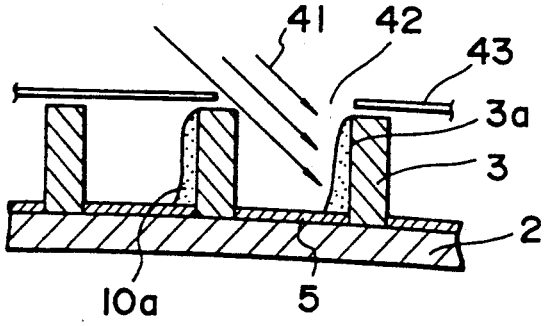

Furthermore, in the case where it is required to form a multiple colored, for example, with red, blue and green colors, fluorescent screen on each of the cells, the formation method is carried out by a method represented by FIG. 22, in which a mask 43 provided with openings 42 at predetermined pattern portions is disposed above the rear plate 2 so as to expose only the wall surfaces 3*a* of the desired cells and this exposure process is repeated with respect to the respective colors by the manner represented by FIG. 19, whereby a fluorescent screen having multiple colors can be formed on the cell wall surface 3*a* of the cell barrier 3. Alternatively, it may be possible to preliminarily precipitate the phosphor only at a desired portion by a screen printing method, for example, and to then simultaneously expose the cell walls of the respective colors.

In the final process, the exposed cell surfaces are calcinated to substantially remove the photosensitive material and leave only the phosphor on the wall surface 3*a* of the cell barrier.

In the described embodiment, the following substances may be used for the phosphors of the respective colors. As a red color phosphor: $Y_2O_3$:Eu, $Y_2SiO_5$:Eu, $Y_3Al_5O_{12}$:Eu, $Zn_3(PO_4)_2$:Mn, $YBO_3$:Eu, (Y,Gd)$BO_3$:Eu, $GdBO_3$:Eu, $ScBO_3$:Eu, $LuBO_3$:Eu; as a blue color phosphor; $Y_2SiO_5$:Ce, $CaWO_4$:Pb, $BaMgAl_{14}O_{23}$:Eu; and as a green color phosphor; $Zn_2SiO_4$:Mn, $BaAl_{12}O_{19}$:Mn, $SrAl_{13}O_{19}$:Mn, $CaAl_{12}O_{19}$:Mn, $YBO_3$:Tb, $BaMgAl_{14}O_{23}$:Mn, $LuBO_3$:Tb, $GdBO_3$:Tb, $ScBO_3$:Tb, $Sr_6Si_3O_8Cl_4$:Eu.

Utilized as a photoresist for dispersing the phosphor is utilized a PVA-ADC, PVA-diazonium salt or the like, while water, alcohol or both mixture may be utilized for a solvent of slurry solution state. The phosphor in the slurry solution occupies 20 to 60 weight % and a vehicle occupies 0.5 to 15 weight %.

In the foregoing description of the third embodiment, the flat substrate of the DC type plasma display panel is only described, but it is a matter of course that this embodiment may be applicable to the AC type plasma display panel in the like manner.

3-2-1 Embodiment 1

An Ni electrode having a width of 300 μm was formed on the glass substrate by a screen printing method and a cell barrier formed on the substrate, the cell barrier having a square structure having a height of 200 μm, a width of 150 μm, a pitch of 500 μm and an inner cell dimension of 350 μm.

A photosensitive coating material was prepared as a phosphor by adding a $Zn_2SiO_4$:Mn (green) of 40 weight % and PVA-diazonium salt of 10 weight % into water.

The thus prepared coating material was poured in the respective cells of the cell barrier on the substrate by utilizing a squeegee, and the substrate was stood vertically to precipitate the phosphor. After drying the same, the predetermined portions of the cell walls were exposed to light at an inclination of about 30° (=arctan (200 μm/350 μm)) by utilizing the mask. The substrate was developed with hot water at a temperature about 40° C. and then dried at a temperature of about 150° C. for about 10 minutes. These processes were repeated four times with respect to the respective cells and three times with respect to the respective colors of red, blue and green. That is, a total of twelve processes were performed. Obtained as the result of these processes, was a plasma display panel including a cell barrier provided with cells each having a cell wall on which only a fluorescent screen having a thickness of about 20 μm has been formed selectively.

3-2-2 Embodiment 2

Figure 23:
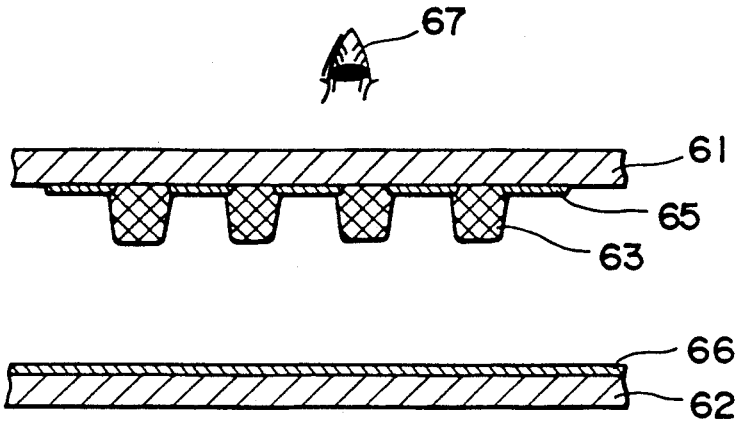

Transparent electrodes 65 each having a width of 200 μm and a pitch of 300 μm were formed on the glass substrate 61 by a deposition method and a cell barrier having linear wall portions 63 between the adjacent electrodes 65 was formed on the substrate as shown in FIG. 23, each of the wall portions 63 having a width of 150 μm and the height of 140 μm.

A photosensitive coating material was prepared as a phosphor by adding $Zn_2SiO_4$:Mn (green) of 40 weight % and PVA-diazonium salt of 10 weight % into water.

The thus prepared coating material was poured in the respective linear wall cells of the cell barrier on the substrate 61 by utilizing a rubber squeegee, and the substrate was stood vertically so that the linear cell wall portions are made horizontal and the phosphor was precipitated. After drying the same, the predetermined linear wall portions of the cell barrier were exposed to light at an inclination of about 45° (=arctan (140 μm/150 μm)) by utilizing the mask. The substrate was developed with hot water of a temperature about 40° C. and then dried at a temperature of about 150° C. for about 10 minutes. These processes were repeated twice with respect to both sides of the respective linear cell wall portions. These processes were performed six times with respect to the respective colors of red, blue and green. As the result of these processes, was obtained a plasma display panel in combination of the glass substrate 61 as the front plate and the rear plate 6 provided with a cathode 66, the plasma display panel being provided with a fluorescent screen only on the linear cell wall portions having a thickness of about 20 μm.

3-3 Effects

As described above, according to this embodiment, it is possible to easily form a fluorescent screen on the wall surface of the cell barrier with high precision and a plasma display panel having an excellent luminance can be prepared by observing the light reflected by the fluorescent screen.

With the embodiments described hereinbefore, there are proposed plasma display panels in which the cells are arranged in a matrix shape, but this invention may be applied to a plasma display panel in which the cells are arranged linearly by substantially the same manner as those described with respect to the described embodiments.

FOURTH EMBODIMENT

4-1 Basic Structure (No. 1)

Figure 24:
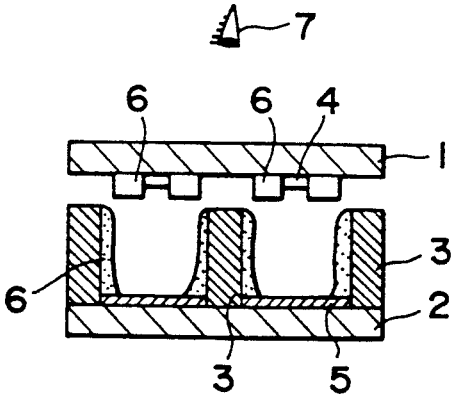
FIGS. 24 and 25 represent the fourth embodiment according to this invention, which are sectional views of the plasma display panels in the course of the formation of the fluorescent screen.

FIG. 24 represents the first basic structure of a plasma display panel of the fourth embodiment according to this invention.

Referring to FIG. 24, a DC type plasma display panel is composed of a front plate 1 made of a glass substrate and a rear plate 2 arranged in parallel to the front plate 1. The rear plate 2 is provided with a front (upper as viewed) surface on which a lattice shaped cell barrier 3 is mounted for defining the space between the rear plate 2 and the front plate 1, and a cathode 5 is further formed on the front surface of the rear plate 2. Anodes 4 are formed on the rear (lower as viewed) surface of the front plate 1, and fluorescent screens 6 are closely formed on both sides of the respective anodes 4. The fluorescent screens 6 are also formed on the wall surfaces of the respective cells of the cell barrier 3.

The fluorescent screen 6 on the front plate 1 is formed in the manner that the photosensitive slurry containing a phosphor is coated on the upper surface of the rear plate 2, the coated slurry is then exposed by using a photomask having a shape corresponding to the pattern of the fluorescent screen, and then developed and calcinated.

The fluorescent screen 6 on the wall surface of the cell barrier 3 is formed in substantially the same manner as that described hereinbefore with respect to the third embodiment in which the slurry solution containing the phosphor is filled in the cells of the cell barrier, the rear plate is stood vertically to precipitate the phosphor, and the phosphor on the cell wall is then exposed.

The fluorescent screen may be formed on a portion of the rear plate 2 except for the location of the cathode 5. In this modification, the slurry solution containing the phosphor is filled in the cell of the cell barrier by the method described with reference to the third embodiment. The phosphor is thereafter precipitated with a suitable time interval on the rear plate 2, which is then inclined to expose the wall portion to the light irradiated from an oblique direction to thereby form the fluorescent screen on the wall surface of the cell barrier 3. Finally, the screen surface is formed by exposing the rear plate 2 to the light from the upward direction by locating the mask so as to cover the cathode 5 and by developing.

4-2 Basic Structure No. 2

Figure 25:
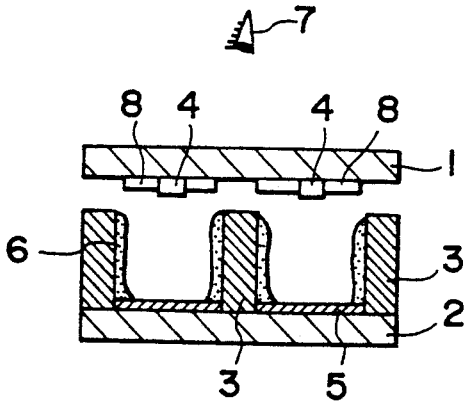

FIG. 25 represents the second basic structure of the plasma display panel of the fourth embodiment according to this invention.

Referring to FIG. 25, a DC type plasma display panel is composed of a front plate 1 made of a glass substrate and a rear plate 2 arranged in parallel to the front plate 1. The rear plate 2 is provided with a front (upper as viewed) surface on which a lattice shaped cell barrier 3 is mounted for defining the space between the rear plate 2 and the front plate 1, and a cathode 5 is further formed on the front surface of the rear plate 2. Anodes 4 are formed on the rear (lower as viewed) surface of the front plate 1, and color filters 8 corresponding to the colors of the fluorescent substance are closely formed on both sides of the respective anodes 4. The fluorescent screens 6 are also formed on the wall surfaces of the respective cells of the cell barrier 3.

The fluorescent screens 6 on the cell walls are formed by substantially the same manner as that described hereinbefore with respect to the third embodiment.

The color filters 8 are formed on the rear surface of the front plate 1 in accordance with the following manner.

A solution prepared by dispersing a pigment and a frit glass in a PVA-diazonium salt is uniformly coated on the surface of the front plate 1, and the coated surface is then exposed so as to expose only the predetermined portions by locating the mask and to harden the coated solution with ultraviolet light. The pigment coated on portions except for the front plate is thereafter removed by developing. Finally the substrate is calcinated for securing the pigment to the substrate.

These processes are performed in substantially the same manner as that described with respect to the respective colors to form the multiple-colored fluorescent screen.

The solution to be coated on the front plate having the following composition was utilized for the fourth embodiment.

| | | |
|---|---|---|
| Pigment | (Blue: Co—Al—Cr oxide; Green: Co—Ni—Ti—Zr oxide) | 30% |
| Vanish | (ethyl-cellurous and butyl-carbitol acetate) | 65% |
| Frit Glass | (low melting point glass) | 5% |

What is claimed is:

1. A method of forming a fluorescent screen for a plasma display panel provided with a front plate and a rear plate disposed parallel to each other and a cell barrier mounted on the front or rear plate and constituting a plurality of cells as display elements, comprising the steps of:

filling a slurry solution containing a phosphor in a portion of the plasma display panel defined by a cell wall of the cell barrier on the plate;

inclining the plate on which the cell barrier is mounted immediately after the filing step at an inclination of about 90 or more degrees with respect to a horizontal plane so that the phosphor-containing slurry solution covers the cell wall and not the plate;

settling the plate in the inclined state until the phosphor in slurry solution is precipitated on the cell wall of the cell barrier; and drying and hardening the cell wall after the precipitating step to form a fluorescent screen on the cell wall only.

2. A method according to claim 1, wherein the slurry solution containing the phosphor is filled in the cell wall by a spraying method.

3. A method according to claim 1, wherein the slurry solution containing the phosphor is filled in the cell wall by a screen printing method.

4. A method according to claim 1, wherein the slurry solution containing the phosphor is filled in the cell wall by a rubber squeegee for a screen printing method.

5. A method according to claim 1, wherein said fluorescent screen is hardened by thermal treatment.

6. A method according to claim 1, wherein said fluorescent screen is hardened by exposure treatment.

7. A method according to claim 1, wherein the slurry solution contains a polyvinyl alcohol and a negative type photoresist and unnecessary phosphor is removed by exposing and developing treatments after the precipitation of the phosphor in the slurry solution.

8. A method according to claim 6, wherein light is irradiated to expose the fluorescent screen from a direction so as not to irradiate a bottom surface of the substrate and so as to expose only the phosphor precipitated on the cell wall of the cell barrier.

9. A method according to claim 7, wherein light is irradiated to expose the fluorescent screen from a direction so as not to irradiate a bottom surface of the substrate and so as to expose only the photosensitive layer in which phosphor precipitated on the cell wall of the cell barrier.

* * * * *